US006600882B1

(12) United States Patent
Applegate et al.

(10) Patent No.: US 6,600,882 B1
(45) Date of Patent: Jul. 29, 2003

(54) MEASURING TONER LEVEL IN A CLOSED CONTAINER

(75) Inventors: Steven Lewis Applegate, Lexington, KY (US); James John Molloy, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/272,920

(22) Filed: Oct. 17, 2002

Related U.S. Application Data

(63) Continuation of application No. 10/158,760, filed on May 30, 2002, now abandoned.

(51) Int. Cl.[7] ..... G03G 15/08

(52) U.S. Cl. ..... 399/27; 73/290 R; 399/61; 399/63

(58) Field of Search ..... 399/27, 63, 61, 399/30; 73/290 R, 297, 304 R; 222/23, 232

(56) References Cited

U.S. PATENT DOCUMENTS 3,926,145 A * 12/1975 Muth ..... 399/64
4,364,659 A * 12/1982 Noda ..... 399/61
4,506,804 A * 3/1985 Oka ..... 399/61
4,615,606 A * 10/1986 Nishikawa
5,797,074 A * 8/1998 Kasahara et al. ..... 399/27
6,100,601 A 8/2000 Baker et al.
6,295,422 B1 9/2001 Curry et al.
6,443,004 B1 * 9/2002 Heuft et al.
2002/0124645 A1 * 9/2002 Wright ..... 73/290 V

FOREIGN PATENT DOCUMENTS

JP 58120398 A * 7/1983

OTHER PUBLICATIONS

William W. Seto, "Schaun's Outline of Theory and Problems of Acoustics," 1971, cover, title page,copyright page, pp. 122 & 123, McGraw–Hill Book Co.

* cited by examiner

*Primary Examiner*—Susan S. Y. Lee
*Assistant Examiner*—Candice C. Campbell
(74) *Attorney, Agent, or Firm*—John A. Brady

(57) ABSTRACT

Toner (5) is measured in a toner cartridge (1) by compressing the air in the upper part (7) of the toner hopper (3). The result of the compression is observed by a diaphragm (13) or, alternatively, by a pressure transducer (25). The volume of air is inversely proportional to the resonant frequency of diaphragm (13) or the pressure at pressure transducer (25). This is converted by control system (23) using direct equations or table look-up of empirical data. The diaphragm (13) carries a magnet (15), which is driven by coil (19) from the imaging device and then frequency of current induced by magnet (15) is then sensed by coil (19). Uneven toner piling is not a significant factor in the results measured.

7 Claims, 1 Drawing Sheet

MEASURING TONER LEVEL IN A CLOSED CONTAINER

RELATED APPLICATION

This application is a continuation of U.S. patent application Ser. No. 10/158,760; filed May 30, 2002 now abandoned.

TECHNICAL FIELD

This invention relates to the measuring of toner remaining in cartridges and other toner containers used in imaging, such as printing and copying.

BACKGROUND OF THE INVENTION

Measuring the amount of toner available in a printer or copier is useful. Such information can be presented to the printer or copier user so that the user can plan cartridge purchases or otherwise plan future use of the imaging device.

Toner is currently measured in a variety of ways, such as by sensing the resistance of a toner paddle which rotates in a toner hopper or sensing toner optically through a window of transparent material in the side of the hopper or other container. Another method employs the weight of the toner to measure its amount.

Since toner takes any number of configurations during use, such as being piled against one side of its container or uneven on it surface, most techniques for measuring toner amount can not compensate fully for the different configurations and are therefore significantly inaccurate. Measuring toner weight does avoid the effects of the different configurations, but requires the entire container, such as a toner cartridge to be accurately weighed.

This invention measures air in the toner container to measure toner amount in an inexpensive way and which avoids the effects of the different configurations.

DISCLOSURE OF THE INVENTION

As escape of toner would soil the user, toner is necessarily kept in a closed container from which air does not readily escape. In such a container, at least one responsive member is located in an upper wall above the toner. The volume of the closed container, which is filled with air and toner, is perturbed and the pressure response of air in the container is observed. Boyles Law inversely relates the volume of air to pressure with pressure times volume being constant.

In the preferred embodiment a diaphragm consisting of a flexible member and a permanent magnet is used to excite the volume of air using a magnetic coil. The excitation can be by a single pulse of current to an exciting coil, in which case the ringing motion of the magnet can be measured using the current response of the coil. Alternately, the excitation can be via a frequency sweeping of sinusoidal current to the exciting coil and the frequency with maximum amplitude used to determine the resonant frequency. The volume of air acts like a spring and the diaphragm-magnet assembly acts as both a mass and a spring in a mass spring system which inherently seeks its resonant frequency, and the resonant frequency is a function of the inverse of the square root of the volume of air in the closed container. As the total volume of the container is known, the volume of toner is directly found as the total volume less the volume of the air measured.

Also, preferably, the subsequent movement of the diaphragm to resonant oscillation is observed through the driven coil, which now generates a current in response to the motion of the magnet mounted to the diaphragm.

BRIEF DESCRIPTION OF THE DRAWINGS

The details of this invention will be described in connection with the accompanying drawings, in which.

BEST MODE FOR CARRYING OUT THE INVENTION

Figure 1:
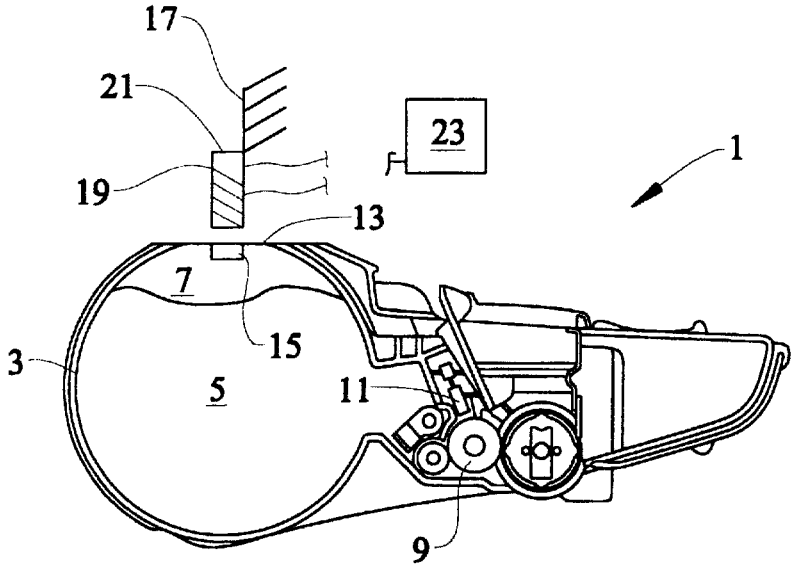
FIG. 1 is a sectioned, side view of a representative cartridge having a toner hopper with a diaphragm.

FIG. 1 shows a representative cartridge 1 having a hopper 3 largely filled with toner 5 and having an upper part 7 filled with only air. The hopper 3 is not hermetically sealed against outside air and the air in upper part 7 is at ambient pressure. However, the hopper 3 is closed against large movement of air so that toner 5 does not escape. This is true even when the toner 5 drops to a low point in which the level of toner 5 is below the roller 9 having a doctor blade 11, as the doctor blade is firmly pressed against roller 9.

Figure 2:
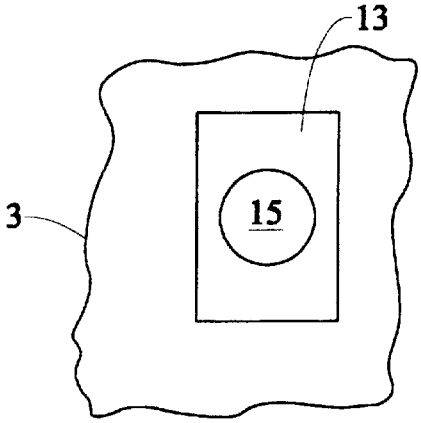
FIG. 2 is a bottom view of the diaphragm showing the diaphragm-magnet assembly.

A diaphragm 13 is at the top of hopper 3 where it will always face air in upper part 7. Diaphragm 13 constitutes part of the top wall of hopper 3. Diaphragm 13 is made of sturdy but resilient material, such as a polyurethane, and has a permanent magnet 15 attached at the center, as shown in FIG. 2. Magnet 15 may be attached by adhesive or otherwise attached or embedded in diaphragm 13.

Located immediately above diaphragm 13 and mounted in the frame 17 of the printer or other imaging device (not shown) is a coil 19 driven from the printer or other imaging device. Coil 19 is wound around a ferromagnetic insert 21 to enhance the magnetic fields from coil 19, as is widely practiced. Coil 19 is under control of the logic and data processing control system 23 (shown illustratively) of the printer or other imaging device. The capabilities of the control system 23 employed in this invention are well within current application and therefore will be described only as functions.

To measure toner volume, control system 23 applies a relatively high current to driven coil 19. By well-known principles, this induces a force in magnet 15. Coil 19 is driven with current in a direction to create a lower polarity opposite to the upper polarity of magnet 15. The opposite polarities attract and this pulls diaphragm 13 upward. Control system 23 then terminates or greatly reduces the current in coil 19. This releases diaphragm 13, which moves toward hopper 3 under its inherent resilience and compresses the air in upper part 7. This perturbed air then tends to force diaphragm 13 upward.

Diaphragm 13 will begin to oscillate up and down, and, as do all mechanical systems free to oscillate, diaphragm 13 will seek its resonant frequency. This is observed by coil 19 by measuring the current through coil 19. This current comprises an alternating current induced by magnet 15 moving up and down near coil 19. This current information is transmitted to control system 23.

Resonant frequency is defined by the spring constant and mass of the mechanical system undergoing oscillations. The spring constant for a perturbed air volume similar to that of FIG. 1 has been described as the density of the air, times the speed of sound in the air squared, times the area of the diaphragm squared, times the reciprocal of the volume. In a toner system of an imaging device the only unknown variable is the reciprocal of volume.

It should be understood, however, the diaphragm will have a spring constant and that the current in the coil 15 used to measure the diaphragm movement will affect the spring content of the diaphragm. Also, the hopper 3 may expand and contract slightly to affect the spring constant. These can be minimized and a pure, mathematical analysis used to translate resonant frequency into volume based on standard data for each cartridge 1 or the like.

In the embodiment shown, the conversion of resonant frequency to volume is by empirical data measured for the system as part of initial manufacture and stored in a table in control system 23. A large number of conversion points are stored representative of full to empty of toner, and measurements between these points are defined by linear interpolation between data points bracketing such points. Such table storage of empirical data and interpolation is widely practiced.

Alternatives

A number of alternatives are apparent, which may be preferable to a single diaphragm or magnetic sensing or magnetic perturbation in particular circumstances.

For example the magnet 15 in the center of diaphragm 13 can be replaced by a coil closed to form an electrical circuit. Such a coil can generate forces by being externally driven or by induction from coil 19.

The perturbation by coil 19 could be effected by continuing pulses across a range of frequencies, with the largest, resulting induced current being recognized as the resonant frequency at the current volume.

The diaphragm frequency could be measured optically by, for example, training an optical beam onto the surface of the diaphragm. This would require a light source and a light sensor, and possibly some focusing hardware.

The perturbation could be effected by a simple plunger, with a separate diaphragm used to observe the resulting oscillations. The plunger could be in a confined passage, which would add mathematical predictability to the results. The diaphragm would be separate and could be sensed by the diaphragm having a piezoelectric element, as well as by magnetic or optical sensing.

Figure 3:
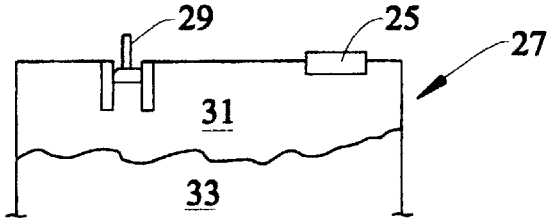
FIG. 3 is a sectioned, side view of a container with a pressure transducer and a separated plunger.

If the measuring diaphragm is replaced by a pressure transducer, then the pressure observed is directly proportional to the reciprocal of the volume by Boyles Law. FIG. 3 illustrates such an alternative, with a separate pressure transducer 25 positioned at the top of a closed container 27 and a separate plunger 29 used to compress air in upper part 31 positioned over toner 33.

Other Considerations

Atmospheric pressure does affect the measurements involved. Where atmospheric pressure may be significantly different from usual, the conversion factors employed by the control system can be adjusted based on conditions at the place of use.

Although there could be some secondary frequencies created by the uneven toner mass, these are believed to be insignificant to satisfactory accuracy of measurement. Accordingly, this invention measures volume without regard to various configurations the toner takes, and the measured volume is therefore quite accurate (of course, the air volume is used to convert to toner volume by subtracting air volume from the known hopper volume).

As illustrated by the foregoing preferred embodiment, implementation requires only limited structure. However, a wide range of alternatives is readily apparent for particular implementations.

The volume of toner in a cleaner container may be of interest, for example, to determine the need for a new cleaner. This invention may be employed as described with a container, which holds used toner.

What is claimed is:

1. A method of measuring toner volume in a closed container having a responsive member facing air in said container comprising:

perturbing said air in said container with a diaphragm or plunger facing said air, observing the response of said responsive member resulting from said perturbing, and converting said observed response into volume of toner in said container.

2. A method of measuring toner volume in a closed container having a responsive member facing air in said container comprising:

perturbing said air in said container, observing the response of said responsive member resulting from said perturbing, and converting said observed response into volume of toner in said container, wherein said responsive member is a diaphragm and said observing is by measuring the resonant frequency of said diaphragm resulting from said perturbing.

3. The method of claim 2 in which said diaphragm contains a magnet and said perturbing is by reaction of said magnet to a magnetic coil.

4. The method of claim 2 in which said diaphragm contains a magnet and said measuring the resonant frequency is by measuring the current induced in a magnetic coil by said magnet.

5. The method of claim 4 in which said perturbing is by reaction of said magnet to said magnetic coil.

6. A method of measuring toner in a closed container having a pressure transducer facing air in said container comprising:

perturbing said air in said container with a plunger, measuring the pressure resulting from said perturbing with said pressure transducer, and, converting said measured pressure into volume of toner in said container.

7. The method of claim 6 in which said plunger is in a confined passage, wherein mathematical predictability of change of said pressure is improved.

* * * * *